US007718055B2

(12) United States Patent
Iou

(10) Patent No.: US 7,718,055 B2
(45) Date of Patent: May 18, 2010

(54) AUTOMATIC CLEANING DRAIN STRUCTURE

(75) Inventor: Lian-Tian Iou, Danshuei Township, Taipei County (TW)

(73) Assignee: Li Lai Den Industrial Co., Ltd., Danshuei Township, Taipei County (TW)

( * ) Notice: Subject to any disclaimer, the term of this patent is extended or adjusted under 35 U.S.C. 154(b) by 0 days.

(21) Appl. No.: 11/783,280

(22) Filed: Apr. 6, 2007

(65) Prior Publication Data

US 2008/0245421 A1 Oct. 9, 2008

(51) Int. Cl.
*E04D 13/04* (2006.01)

(52) U.S. Cl. ..... 210/156; 210/163; 210/355; 210/415; 210/460; 52/302.1

(58) Field of Classification Search ..... 210/156, 210/157, 163, 166, 354, 355, 413, 415, 460, 210/474, 489; 52/12, 302.1
See application file for complete search history.

(56) References Cited

U.S. PATENT DOCUMENTS 664,833 A * 1/1901 Collins ..... 210/355
969,364 A * 9/1910 Grootenhuis ..... 210/354
1,033,745 A * 7/1912 Smith ..... 210/355
1,180,018 A * 4/1916 Degnan ..... 210/163
1,741,444 A * 12/1929 Slider et al. ..... 210/355
2,125,532 A * 8/1938 Wells ..... 210/415
2,332,965 A * 10/1943 Ducommun et al. ..... 210/460
3,341,020 A * 9/1967 Sivadon ..... 210/163
4,487,690 A * 12/1984 Logsdon ..... 210/163
4,658,449 A * 4/1987 Martin ..... 210/163
5,618,416 A * 4/1997 Haefner ..... 210/163
6,089,790 A * 7/2000 Berry et al. ..... 210/157
6,261,445 B1 * 7/2001 Singleton ..... 210/163
7,141,158 B2 * 11/2006 Hong ..... 210/156

* cited by examiner

*Primary Examiner*—Christopher Upton
(74) *Attorney, Agent, or Firm*—Muncy, Geissler, Olds & Lowe, PLLC

(57) ABSTRACT

An automatic cleaning drain structure includes a cover member, a base, a fan blades set and an object expeller set. The fan blades set is installed interior of a holding space of the base A wind power device extends from the object expeller set, and functional connection of the bearing between the fan blades set and the wind power device is used to effect rotation thereof, Accordingly, when a water flow flows past the fan blades set or the wind power device is blown by the force of wind, then a plurality of strip members of the object expeller set and a plurality of strip members of the wind power device rotate around the cover member about the bearing as center, thereby enabling the drain to achieve the objective of clearing away foreign objects to allow unimpeded water flow.

3 Claims, 8 Drawing Sheets

AUTOMATIC CLEANING DRAIN STRUCTURE

BACKGROUND OF THE INVENTION (a) Field of the Invention

The art of the present invention provides an automatic cleaning drain structure, and more particularly to a drain that uses the driving force of wind power and water power to drive and rotate strip members.

(b) Description of the Prior Art

Referring to FIG. 1 and FIG. 2, a drain A of prior art comprises a cover A1 configured with a plurality of stop strips A2. The stop strips A2 are joined to a bottom disk A3, and the bottom disk A3 is joined to a bottom portion A4. When the drain A is used outdoors to channel water flow and separate foreign objects A5, then the foreign objects A5 easily become intermixed with the water flow, and the intermixed foreign objects A5 easily become entrapped on the cover A1, thereby resulting in an accumulating retention of the foreign objects A5 on the cover A1 and increasing thickness thereof, causing the drain A to become blocked and thereby losing effectiveness to allow unimpeded water flow.

Hence, the inventor of the present invention proposes to resolve and surmount existent technical difficulties to eliminate the aforementioned shortcomings of prior art.

SUMMARY OF THE INVENTION

The art of the present invention provides an automatic cleaning drain structure, and more particularly to a drain that uses the driving force of wind power and water power to drive and rotate strip members to effectively clean out foreign objects on a cover member, thereby enabling achieving an unclogged drain which enables unimpeded flow of a drainage channel.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
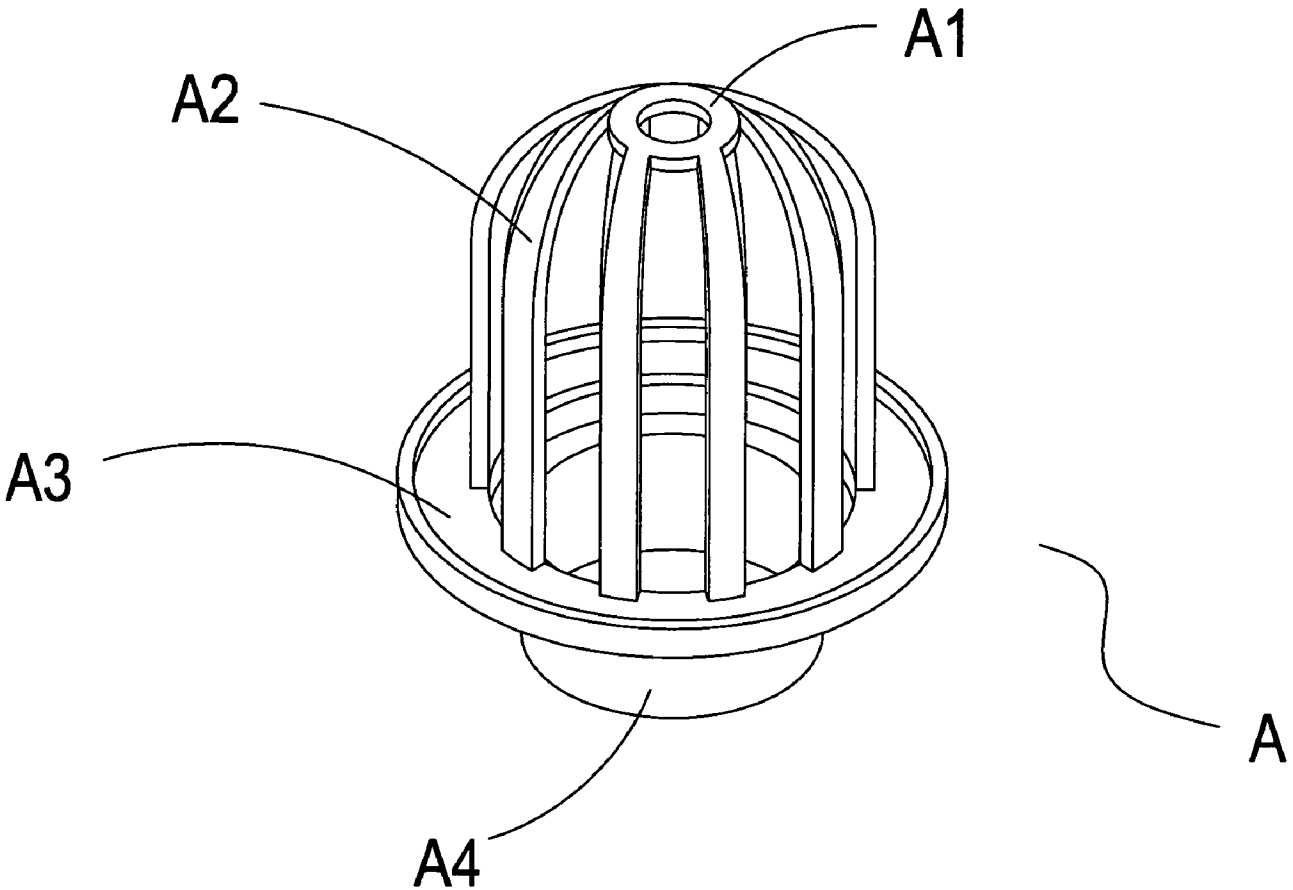
FIG.1 Prior Art
FIG. 1 shows an elevational view of prior art.
Figure 2:
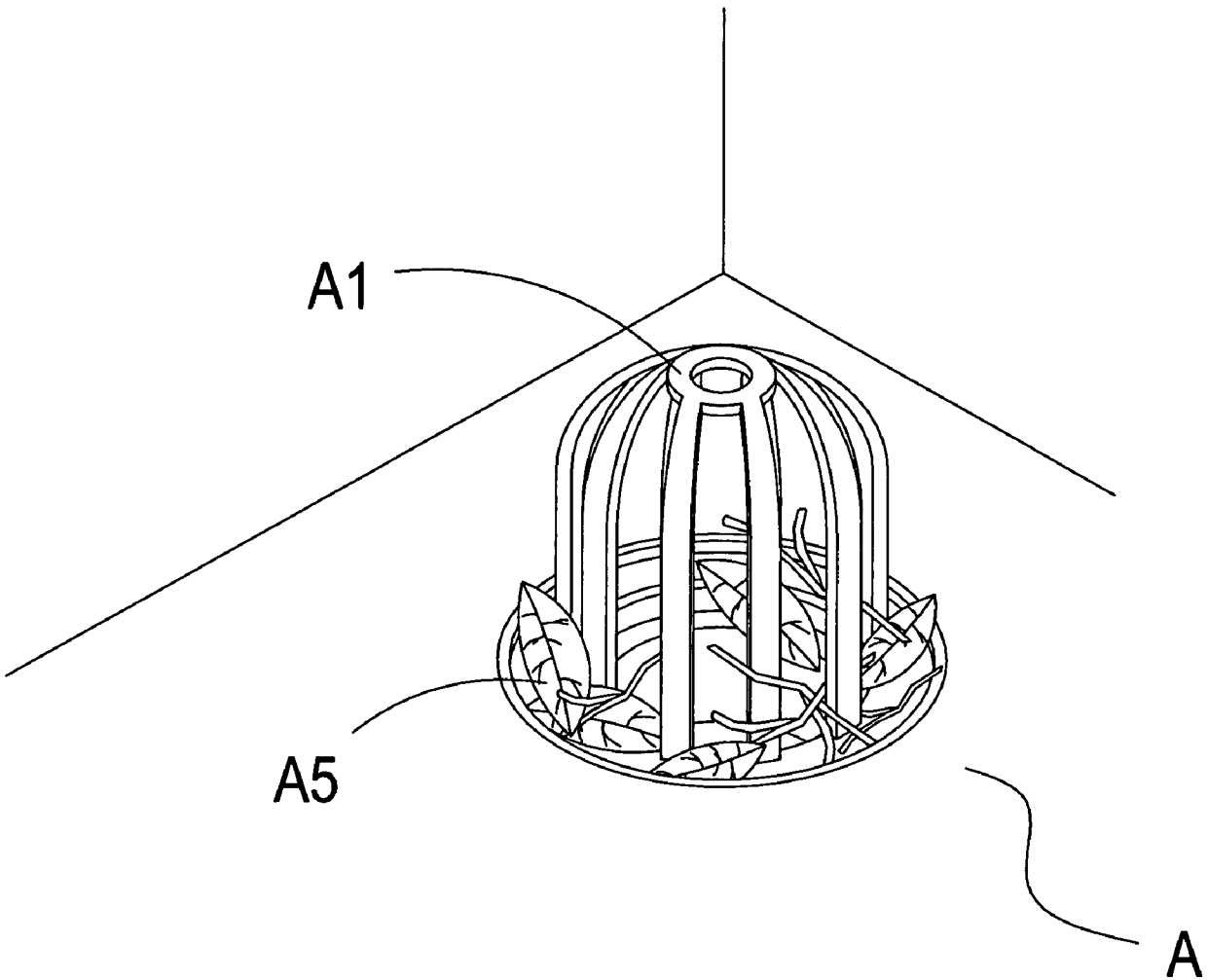
FIG.2 Prior Art
FIG. 2 shows an embodiment of prior art.
Figure 3:
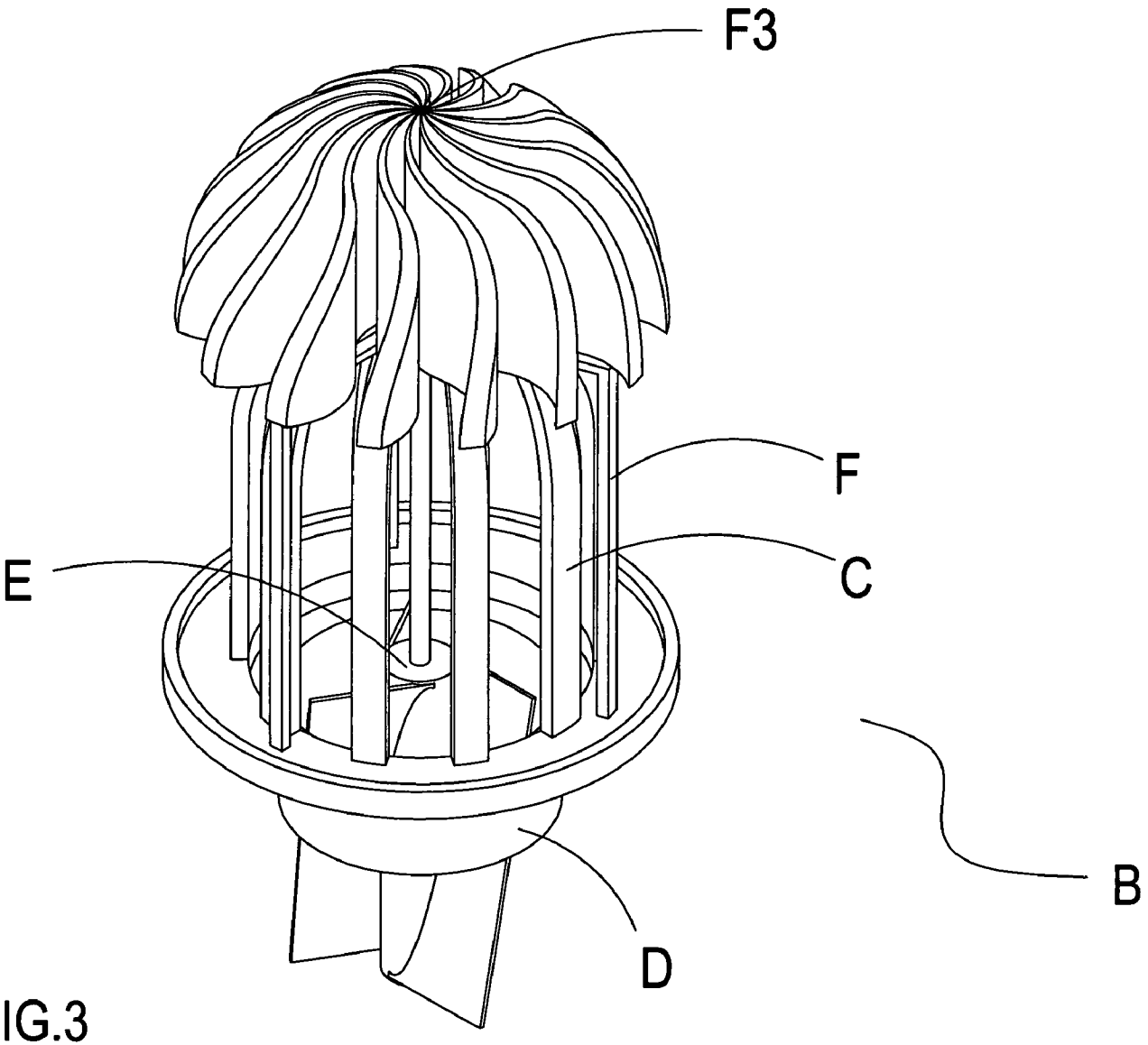
FIG. 3 shows an elevational view according to the present invention.
Figure 4:
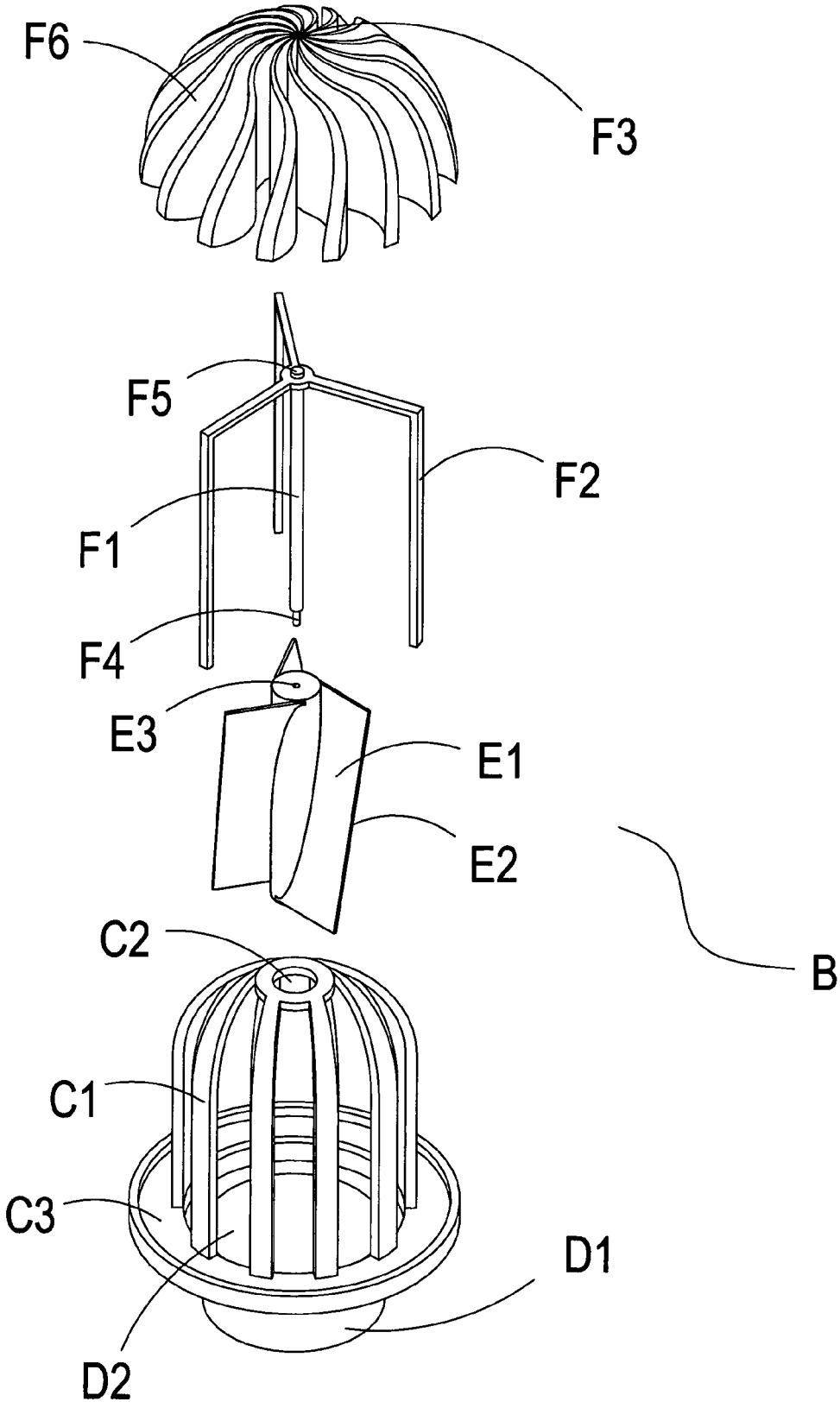
FIG. 4 shows an exploded elevational view according to the present invention.

Referring to FIGS. 3 and 4, which show an automatic cleaning drain structure of the present invention, wherein a drain B is structured to comprise a cover member C, a base D, a fan blades set E and an object expeller set F. The cover member C is configured with a plurality of side strips C1, an end of each of which converges at a top end where they join together to form a through hole C2, and another end of each of the side strips C1 is joined to a fixing disk C3 that extends and joins to the base D. The base D comprises a bottom base D1, and a holding space D2 is defined between the bottom base D1 and the fixing disk C3. The fan blades set E, which is configured with a plurality of blades E1, is installed interior of the holding space D2, and each of the blades E1 extend and set at a slant angle E2 to enable the fan blades set E to rotate in the same direction. Moreover, an opening E3 penetrates a center of the fan blades set E, and a bearing F1 of the object expeller set F extends from the opening E3. A connecting head F4 at one end of the bearing F1 is fixedly joined to the opening E3, and a plurality of strip members F2 are fixedly joined to a connecting head F5 at another end of the bearing F1. Moreover, a wind power device F3 configured with a plurality of strip members F6 further extends from the bearing F1, and the plurality of strip members F6 externally surround the cover member C. Accordingly, connection of the bearing F1 to and rotation of the strip members F2 are used to achieve the objective of cleaning the cover member C and enable unimpeded water flow.

Figure 5:
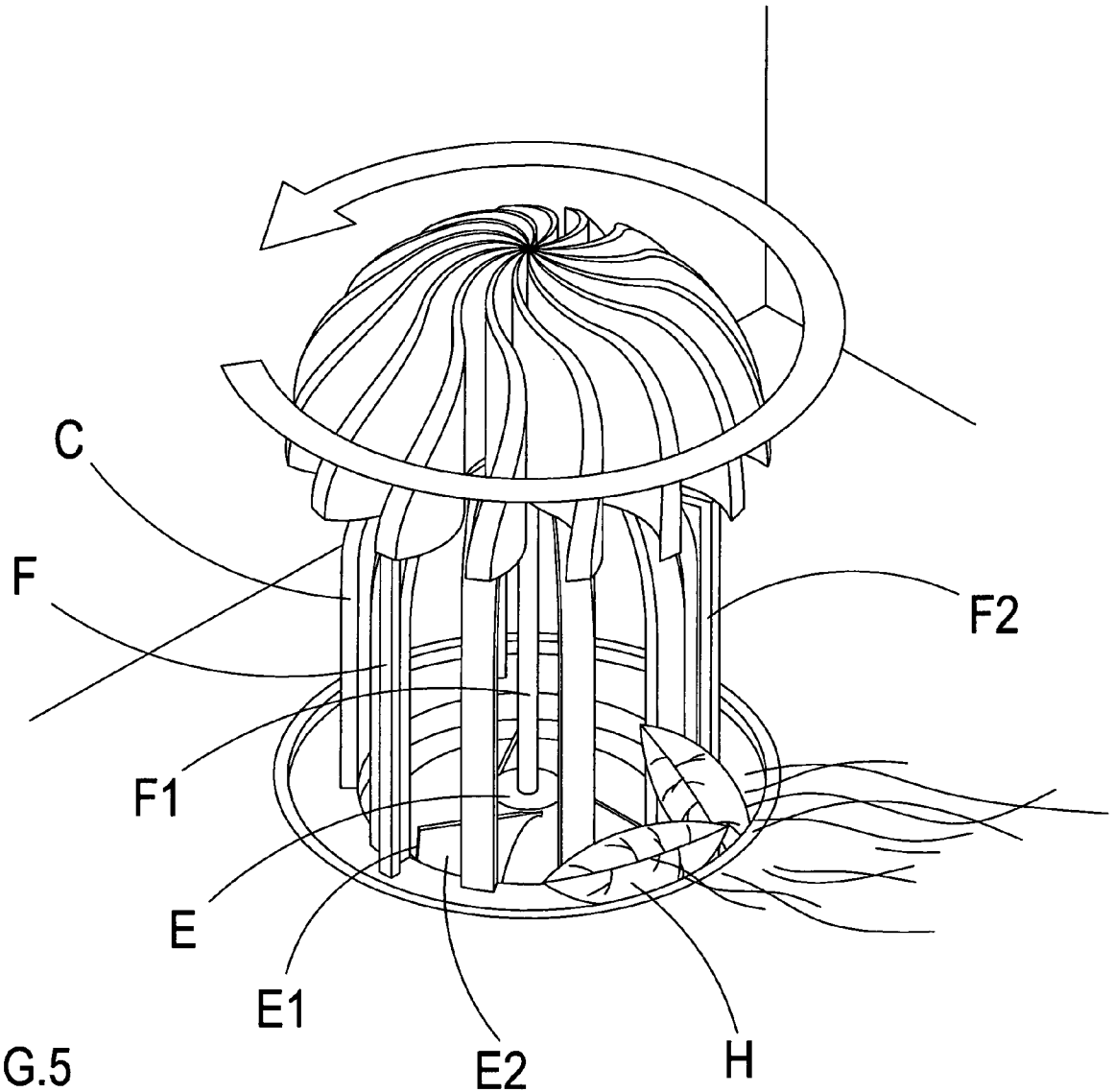
FIG. 5 shows a first partial schematic view according to the present invention.
Figure 6:
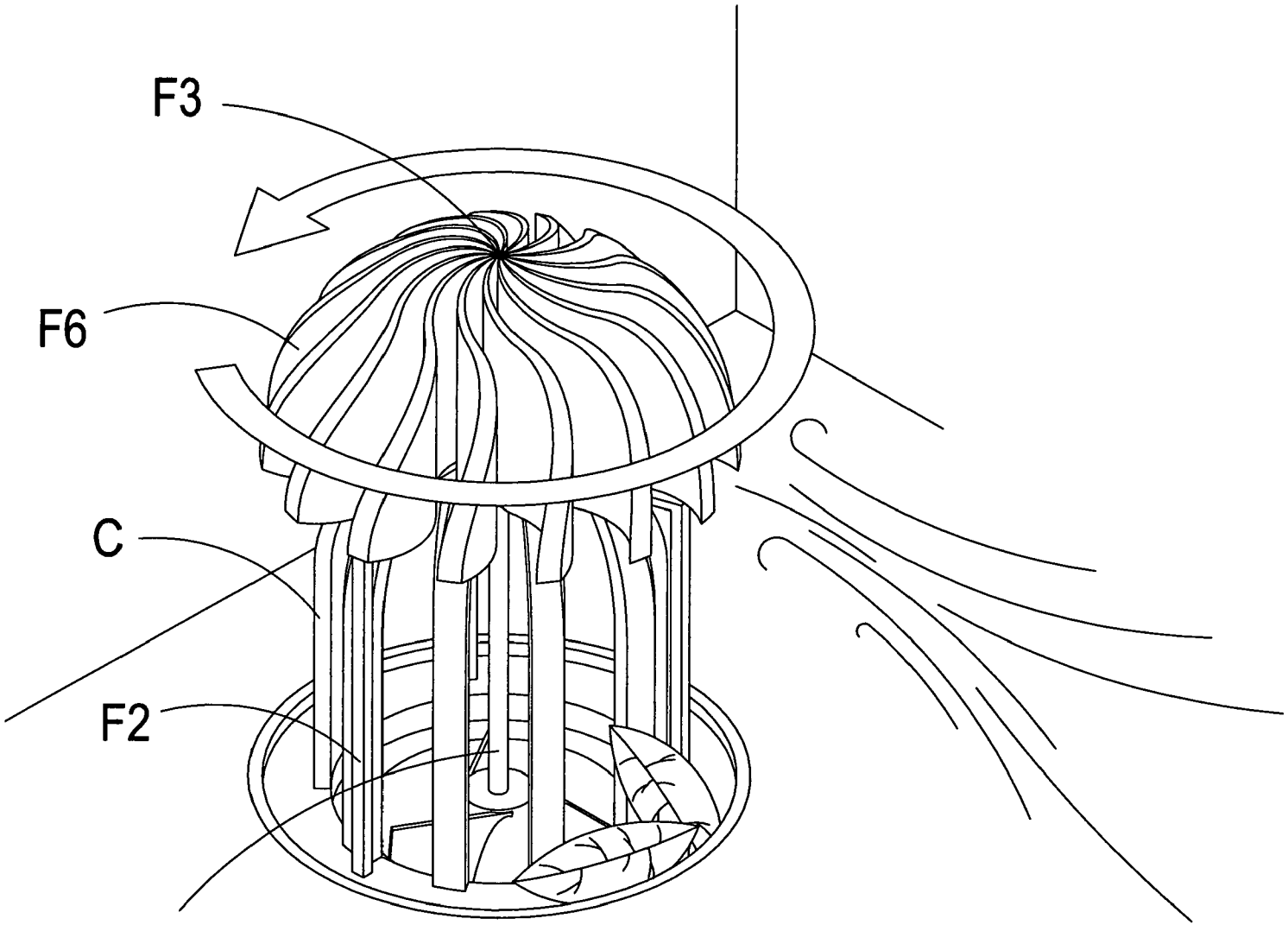
FIG. 6 shows a second partial schematic view according to the present invention.

Referring to FIGS. 5 and 6, which show an embodiment of the automatic cleaning drain structure of the preset invention, wherein each of the blades E1 of the fan blades set E is configured at the slant angle E2, and when a water flow flows past the slant angles E2, then force of the water flow causes the blades E1 to move in one direction. Moreover, the bearing F1 extending from and joined to the fan blades set E is further joined to the object expeller set F and the wind power device F3, Hence, when the fan blades set E rotates in one direction, then the bearing F1 is able to simultaneously rotate in the same direction, which further enables the bearing F1 to drive the object expeller set F and the wind power device F3, and when the object expeller set F and the wind power device F3 rotate, then the object expeller set F and the strip members F6 of the wind power device F3 rotate around the cover member C about the bearing F6 as center. Hence, when a water flow is flowing, the drain B is able to use rotation of the strip members F2 to achieve the objective of clearing away foreign objects H and allow unimpeded water flow. Moreover, when the wind power device F3 is blown by the force of wind, then the strip members F6 of the wind power device F3 surrounding the cover member C simultaneously rotate around the cover member C about the bearing F6 as center, and the bearing F1 drives and rotates the strip members F2 of the object expeller set F on the cover member C. Hence, when a water flow is flowing, the drain B is able to simultaneously use natural forces of water power and wind power to achieve the objective of clearing away the foreign objects H and allow unimpeded water flow.

Figure 7:
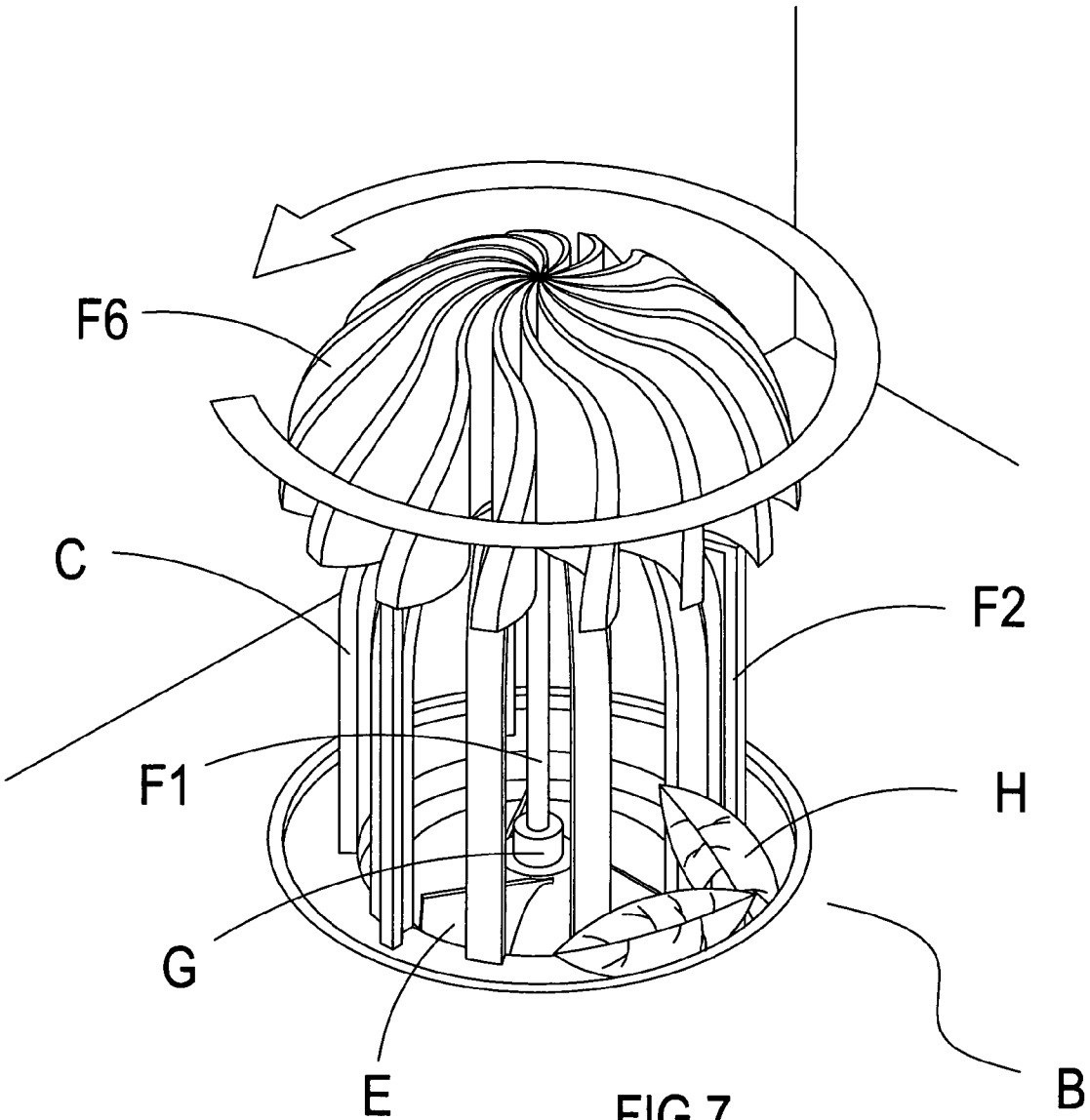
FIG. 7 shows an elevational view of another embodiment according to the present invention.

Referring to FIG. 7, a drive device G can be additionally disposed at a bottom portion of the fan blades set E, whereby if the foreign objects H have already accumulated on the drain B, and there is no water power and wind power to drive and rotate the strip members F2, then the drive device G can be activated to drive and rotate the bearing F1, thereby enabling rotation of the bearing F1 to be used to drive the strip members F2 surrounding the cover member C to rotate around the cover member C about the bearing F6 as center and achieve the objective of clearing away the foreign objects H, thus allowing unimpeded water flow. Furthermore, installation of the drive device G is used to avoid the danger resulting from when a user wants to clean out the accumulated foreign objects H on the drain B, including the greater danger of wanting to clean out the foreign objects H on the drain B installed on a sloping rooftop.

Figure 8:
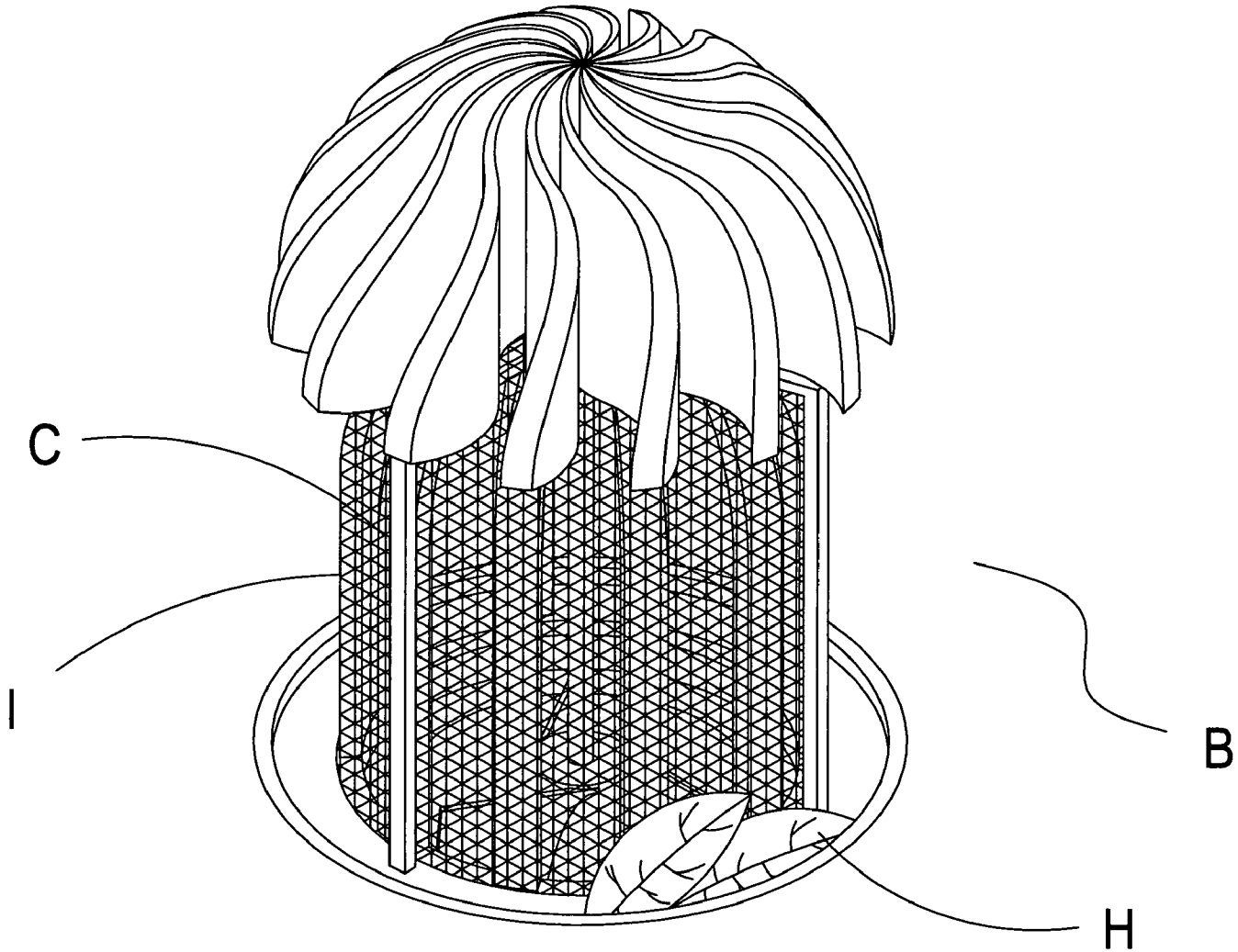
FIG. 8 shows an elevational view of another embodiment according to the present invention.

Referring to FIG. 8, a screen I can be additionally disposed on the cover member C of the drain B, whereby the screen I covers the cover member C, thus aiding the drain B in separating the foreign objects H and more effectively cutting off the foreign objects H from entering into the drain B.

In order to better explicitly disclose advancement and practicability of the present invention, a comparison with prior art is described hereinafter:

Shortcomings of Prior Art

1. Only a cover is used to separate foreign objects.
2. Foreign objects are easily entrapped on the cover.
3. The drain easily becomes blocked as foreign objects accumulate and become thicker on the cover, thereby impeding water flow.
4. There is a high risk of danger when cleaning out the drain installed on a sloping rooftop.

ADVANTAGES OF THE PRESENT INVENTION

1. After the cover member C separates foreign objects then the strip members F2 are able to clear away the accumulated foreign objects.
2. Wind power and water power is used to drive the strip members F2 and clear away foreign objects.
3. When there is no wind and water, then the drive device G can be used to drive the strip members F2.
4. Prevents ambulation of foreign objects.
5. Maintains clearance of the drain B, thereby facilitating unimpeded water flow.
6. Eliminates the danger resulting from cleaning out foreign objects in the drain B.
7. Provided with advancement and practicability.
8. Enhances industrial competitiveness.

In conclusion, the present invention in overcoming structural shortcomings of prior art has assuredly achieved effectiveness of anticipated advancement, and moreover, is easily understood by persons unfamiliar with related art. Furthermore, contents of the present invention have not been publicly disclosed prior to this application, and practicability and advancement of the present invention clearly comply with essential elements as required for a new patent application. Accordingly, a new patent application is proposed herein.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. An automatic cleaning drain structure, wherein a drain comprises:

a cover member, comprising a plurality of side strips, an end of each of which converges at a top end to form a through hole, and another end of each of the side strips is correspondingly joined to a fixing disk;

a base, comprising a bottom base, which is joined to the fixing disk to form a holding space;

a fan blades set installed interior of the holding space, provided with a plurality of blades to enable rotation of the fan blades set, moreover, the plurality of blades converge and are joined to an opening; and an object expeller set installed on the cover member, comprising a plurality of strip members that cover the cover member, moreover, the strip members converge and are joined to a bearing, and a wind power device extends from an end of the bearing, and another end of the bearing is joined to the opening of the fan blades set;

whereby flow of water past the fan blades set and rotation of the wind power device is used to drive the bearing, and rotation of the bearing drives and rotates the strip members on the cover member to facilitate effectively removing foreign objects on the cover member, thereby achieving the objective of cleaning the drain of residual foreign objects to allow unimpeded water flow, wherein the drain further comprises a drive device installed at a bottom portion of the fan blades set to provide a rotating driving force to the strip members, thereby enabling removal of residual foreign objects.

2. The automatic cleaning drain structure according to claim 1, wherein a screen is disposed on the cover member, thereby enabling the drain to effectively separate residual foreign objects on the cover member.

3. The automatic cleaning drain structure according to claim 1, wherein each of the blades is configured at a slant angle to enable, whereby configuration of the slant angles causes the fan blades set to rotate in one direction when a water flow flows past the blades, thereby driving and rotating the strip members of the object expeller set on the cover member.

* * * * *